United States Patent [19]

Hwang

[11] Patent Number: 4,754,623

[45] Date of Patent: Jul. 5, 1988

[54] ADJUSTABLE COMBINATION NUMERICAL LOCK

[76] Inventor: Blake Hwang, No. 40, Chao-an Street, Taipei, Taiwan

[21] Appl. No.: 1,188

[22] Filed: Jan. 7, 1987

[51] Int. Cl.[4] ..... E05B 37/14

[52] U.S. Cl. ..... 70/25; 70/316; 70/312

[58] Field of Search ..... 70/25, 315, 316, 317, 70/318, 22, 24, 312, 26

[56] References Cited

U.S. PATENT DOCUMENTS

| | | | |
|---|---|---|---|
| 3,592,027 | 7/1971 | Wako | 70/5 |
| 3,720,082 | 3/1973 | Feinberg | 70/25 |
| 3,766,758 | 10/1973 | Heine | 70/25 |
| 4,048,821 | 9/1977 | Beko | 70/25 |
| 4,341,099 | 7/1982 | Garro | 70/25 |
| 4,531,388 | 7/1985 | Garro | 70/25 |

*Primary Examiner*—Robert L. Wolfe

*Attorney, Agent, or Firm*—Morton J. Rosenberg

[57] ABSTRACT

An adjustable combination numerical lock comprising a hook, a first tray, a second tray, a contact chip, two or more number dials, springs and driving rolls. The number dials, the springs, and the driving rolls are respectively set in the second tray, and the hook wedged with the contact chip is put on the two trays. When this lock is locked, the sliding strips do not engage with the recesses of the driving rolls, thereby allowing the driving rolls to rotate with the number dials. Therefore, the sliding strips will be prevented from sliding up if the combination is off. When the numbers are put into the right combination, the lock is opened and the sliding strips are partly engaged with the recesses so that the hook can be pulled up. The combination of the lock can be changed (while in opening combination) by turning the hook right 90 degrees and then pulling it up so that the sliding strips are completely engaged with the recesses. This keeps the driving rolls from rotating with the number dials. Then, the number dial may be adjusted to a new combination by pressing the hook down and returning the hook to its original position.

2 Claims, 3 Drawing Sheets

ADJUSTABLE COMBINATION NUMERICAL LOCK

BACKGROUND OF THE INVENTION

This invention relates to an adjustable combination numerical lock, especially to an adjustable combination numerical lock utilizing fewer elements to change the combination.

Originally, locks were designed so as to use a key to open them. But it is very inconvenient to carry keys around all the time and it often occurs that keys are lost or stolen. Therefore, manufacturers developed combination numerical locks which used a fixed combination of numbers to lock instead of key locking so that users would not have to worry about carrying too many keys and losing their keys. But as the combination numbers of the numerical lock is pre-set and can not be changed, the combination numbers may easily be acquired.

Therefore, this invention discloses a numerical lock which has an adjustable combination and utilizes a simpler construction to provide greater protection against theft.

SUMMARY

A primary objective of this invention is to provide an adjustable combination numerical lock on which the combination can easily be changed so as to prevent the things locked thereby from being stolen.

Another objective of this invention is to use fewer elements than the prior art and simpler technology to construct this lock.

Further objectives and advantages of the present invention will become apparent as the following decription proceeds, and the features of novelty which characterize the invention be pointed out with particularity in the claims annexed to and forming a part of this invention.

DETAILED DESCRIPTION OF THE PREFERRED EMBODIMENT

The elements of the adjustable combination numerical lock of this invention do not depend on how many digits are desired in the combination set (i.e. how many number dials are used therein).

Figure 1:
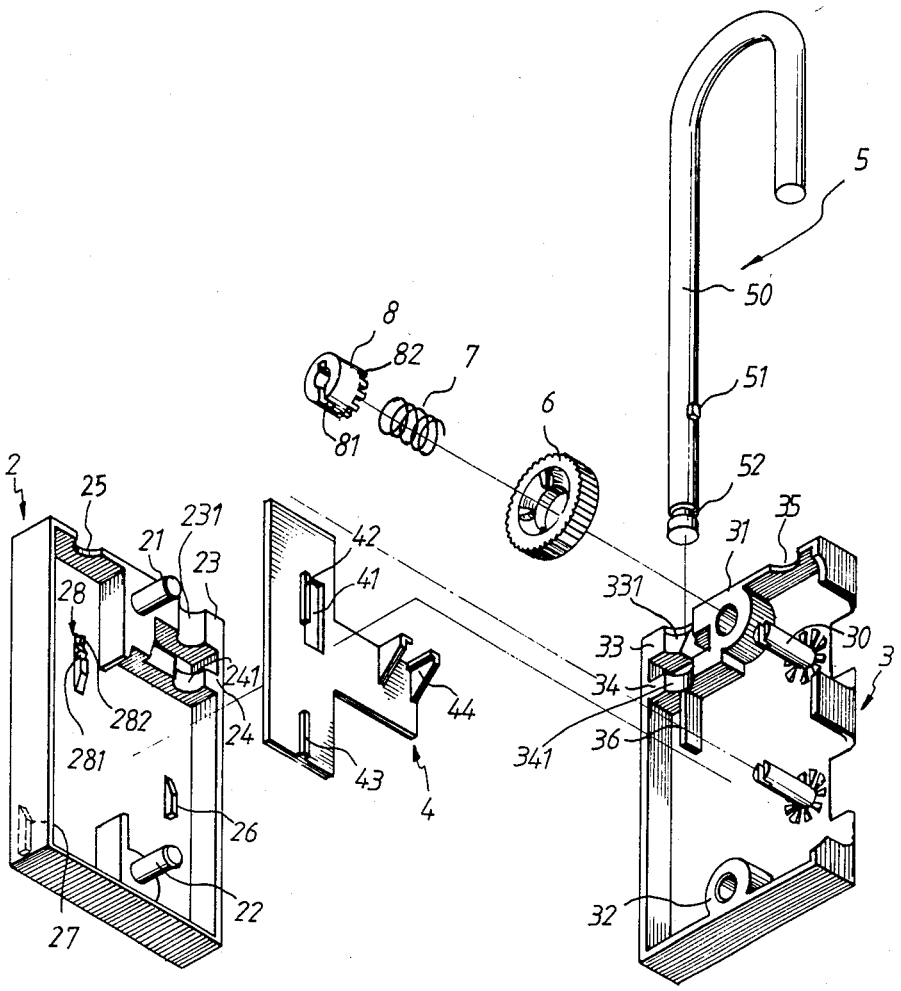
FIG. 1 is an exploded view of the adjustable combination numerical lock of this invention.

Referring to FIG. 1, it can be seen that the numerical lock of this invention comprises a first tray 2, a second tray 3, a contact chip 4, a locking hook 5, two or more dials 6, springs 7 and driving rolls 8 as shown in FIG. 1. Referring to FIG. 1, it can be seen that the numerical lock of the invention is assembled by the following steps: (1) place the number dials 6, springs 7 and the driving rolls 8 on the protrusion axes 30 of the second tray 3; (2) put the circumferential groove 52 of the lower portion of the shank 50 wedged with the pair of triangular wedges 44 of the contact chip 4 so that the contact chip 4 will move up and down when the hook 5 moves; and (3) put the shank 50 on the semi-circular holes 331 and 341 of the second tray 3 (or semi-circular holes 231 and 241 of the first tray 2), and then engage the first tray 2 and the second tray 3 to form the numerical lock of this invention.

In detail, the first tray 2 comprises a solid body which is composed of two parallel planes 23 and 24 (one forms a part of the top wall) and a pair of cylindrical pillars, 21 and 22. The second tray 3 also has two parallel planes, 33 and 34, which are the same as that of the first tray 2. The second tray 3 further has a pair of cylindrical holes (31 and 32) at the corresponding positions with the cylindrical pillars 21 and 22 of the first tray 2 so as to engage the two trays 2 and 3 together. The two parallel planes of the first tray 2 and the second tray 3 each have a semicircular hole and which combines with another semicircular hole 25 (in the first tray 2) or 35 (in the second tray 3) so as to reset the hook 5 herein. Further, the first tray 2 comprises three support blocks 26, 27 and 28 which are installed for support the contact chip 4. Note the three support blocks are installed at the right positions so that the two support blocks (26 and 27) are exactly under the contact chip 4 and the support block 28 is enveloped on an opening 41 of the contact chip 4 when the hook 5 is pulled up at its highest position. The support block 28 has a special shute 281 on the support block 28 and a front shute 282 on the front end thereof which engage with the protruberance of the back of the front end of the opening 41 of the contact chip 4 when the contact chip 4 is pulled up when the lock is opened or the combination is changed.

The hook 5 comprises a projection 51 which is installed on the lower portion of the shank 50 above the circumferential groove 52 and directed to hooking portion 54 and when the hook 5 is reset in the semi-recess hole of the first tray 2 or the second tray 3, the projection 51 is directed inward. Further, plane (24 and 34) is shorter than plane (23 and 33) so that the hook 5 can more easily be pulled up when the lock is opened. One side of the second tray 3 has two concave portions, each portion having a protrusion axis 30 installed thereon. The two protrusion axes 30 are vertically lined up with the semi-circular hole 35 and each protrusion axis has a recess on the top thereof and a plurality of strips around the circumference on the bottom thereof. The number dial 6, the spring 7 and the driving roll 8 respectively reside on the protrusion axis 30. The number dials 6 each has been carved many numbers on one face, e.g. 0–9, and one number is visible when the number dial 6 is turnably set on the protrusion axis 30 and the other face has some teeth. The driving rolls 8 are smaller than the number dials 6. The front face of the driving rolls 8 have a halfclosed recess 81 and the back face has a plurality of teethed projections 82. Note the opening of the halfclosed recess 81 is downward so that the sliding strips 42 of the contact chip 4 can slide in the recess 81 but not slide across it. Further, the second tray 3 comprises a support block 36 connected with the solid body for supporting the shank 50 of the hook 5 therein.

The contact chip 4 has a 'T' shape which comprises two sliding strips 42 and 43, an opening 41, a protruberance 45 behind the front end of the opening 41 (as can be seen in FIG. 3) and a pair of triangular wedges 44. The pair of triangular wedges is normally reset on the extending end of the contact chip which is tapered in the front end so as to wedge the smaller diameter portion (i.e. the circumferential groove 52) of the hook 5. When the hook 5 is wedged, the contact chip 4 will move up and down with the hook 5. The opening 41 is beyond the upper sliding strip 42 which can cross the support block 28 when the contact chip 4 is pulled up at its highest position and the protruberance 45 behind the front end of the opening 41 will engage with the shute 281 and 282 of the support block 28 when the lock is opened or while the combination number is being changed.

Figure 2A:
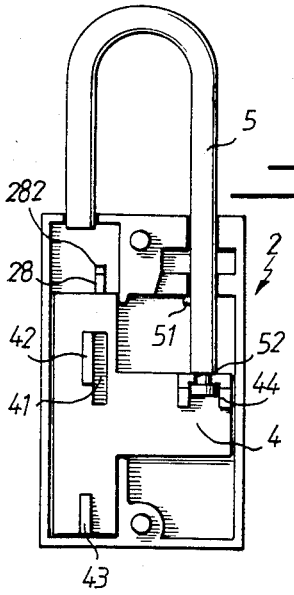
FIG. 2A is a front cross-sectional view showing the relationship between the first tray, and the contact chip with the hook of the adjustable combination numerical lock of this invention when the lock is locked.
Figure 2B:
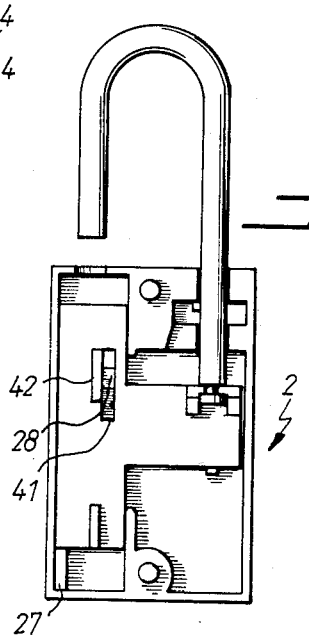
FIG. 2B is a front cross-sectional view showing the relationship between the first tray, the contact chip and the hook when the lock is open.
Figure 2C:
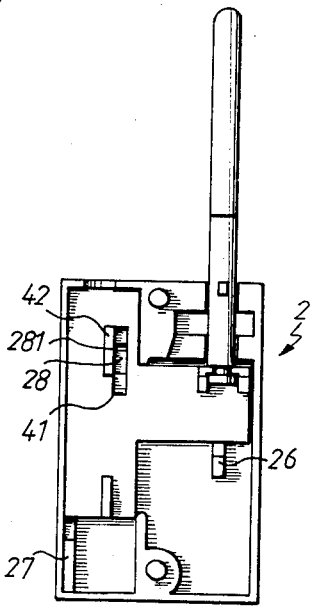
FIG. 2C is a front cross-sectional view showing the relationship between the first tray, the adjustable combination and the hook of this invention when the combination of the lock is being changed.
Figure 3A:
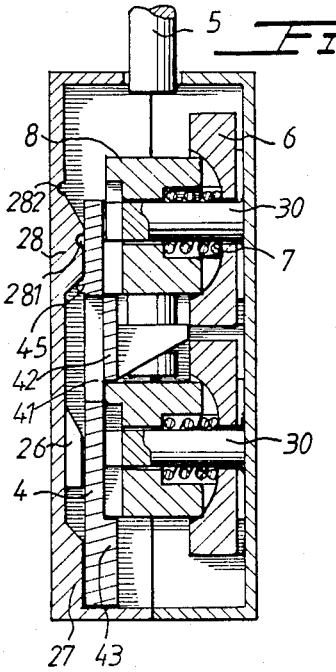
FIG. 3A is a cross-sectional view of FIG. 2A when the lock is locked.
Figure 3B:
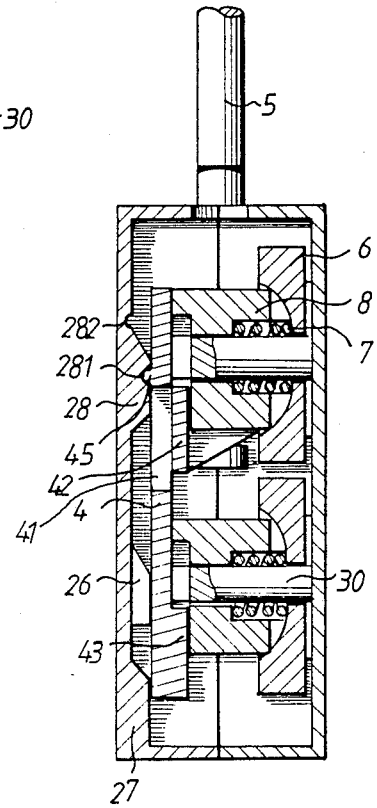
FIG. 3B is a cross-sectional view of FIG. 2B when the lock is opened.
Figure 3C:
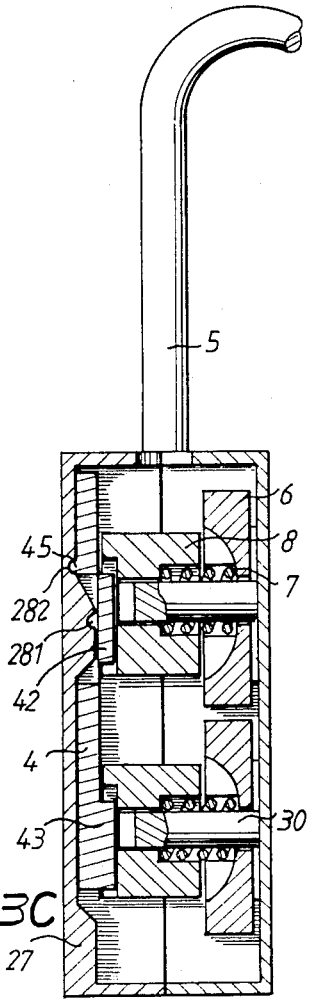
FIG. 3C is a cross-sectional view of FIG. 2C when the combination of the lock is being changed.

Referring to FIG. 2A, B, and C, the relationship between the first tray 2, the contact chip 4 and the hook 5 can be seen. The corresponding cross-sectional views when the lock is locked, opened and be changing combinations can be seen in FIG. 3. In FIG. 2A and 3A, the lock is locked and the contact chip 4 is on its lowest position. It can be seen that the projection 51 of the hook 5 is beneath the second plane 34 of the second tray 3. The sliding blocks, 42 and 43, do not engage with the recesses 81 of the driving rolls 8 so that the driving rolls 8 will rotate with the number dials 6. Therefore, the sliding blocks, 42 and 43, will not slide up (i.e. the hook 4 can not be pulled up) if the combination is not set. In FIG. 2B and 3B, it can be seen that the two sliding blocks 42 and 43 are partly engaged with the recesses 81 of the driving rolls 8 and further the protruberance 45 of the back of the contact chip 4 is engaged with the shute 281 of support block 28 when the lock is opened. Since the height of plane 24 is shorter than that of plane 23 as mentioned hereinbefore, the projection 51 can be forced to pass through the plane 23 by an external force. Note the contact chip is supported by the support blocks 26, 27 and 28 at the previously mentioned position. When changing the combination, the hook 5 should first be turned clockwise 90 degrees for preventing the projection 51 of the hook 5 from being blocked by the plane 23 when pulled up, and then pulled up, as shown in FIG. 2C. FIG. 3C shows its side cross-sectional view. It can be seen that the support block 28 crosses the opening 41 (the contact chip 4 is completely attached with the first tray) and the protruberance 45 has engaged with the front shute 282 of the support block 28. Further, the two sliding blocks 42 and 43 are completely engaged with the recesses 81 of the driving rolls 8 to keep the driving rolls 8 from rotating with the number dials 6.

Adjust the number dials 6 and choose one combination, press the hook 5 down and return it to its original position so as to perform all the procedures of changing the combination. Therefore, when locking the numerical lock again, the number dials 6 should be adjusted at its new combinations so as to open the lock since the driving rolls 8 will rotate with the number dials again.

If have a more complex combination (i.e. more digits), the numerical lock of this invention can be altered by adding more elements, such as more numerical dials, springs, driving rolls. Therefore, as various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. An adjustable combination numerical lock comprising:

(a) a hook (5) having a circumferential groove (52) on a lower portion of a shank (50) and a projection (51) located on said lower portion above said circumferential groove (52);

(b) a first tray (2) and a second tray (3) which engage each other to form a housing; each of said trays (2 and 3) respectively having two semicircular holes (25, 231 and 35, 331) at a respective top wall thereof and a respective plane (24, 34) having respective semi-circular holes (241, 341) which are parallel to one of said semi-circular holes (25, 231 and 35, 331) of one of said top walls; a pair of cylindrical pillars (21, 22) on said first tray (2) for engaging with respective holes (31, 32) on said first tray (2) for engaging said first and second tray (2 and 3) together; said first tray (2) further comprising a first, second, and third support block (26, 27 and 28) installed on three respective different positions for supporting a contact chip (4), said third support block (28) having two shutes (281, 282) installed respectively on a front and a middle of said third support block (28), one side of said second tray (3) having two or more concave portions on which are respectively installed two or more protrusion axes (30); said protrusion axes (30) each having a recess on a top end thereof and a plurality of strips around a periphery thereof; said second tray (3) further comprising a support block (36) connected with one of said planes (34);

(c) at least two number dials (6), each number dial (6) being numbered 0 to 9 on one face thereof and a plurality of teeth corresponding to respective positions of said numbers on another face thereof;

(d) at least two springs (7);

(e) at least two driving rolls (8) each having a half-closed recess (81) on one face thereof and a plurality of toothed projections (82) on another face thereof;

(f) a contact chip (4) being T-shaped and comprising an upper sliding strip (42), a lower sliding strip (43), an opening (41) and a pair of triangular wedges (44); said pair of triangular wedges (44) being installed on an extending portion of said contact chip (4); a distance between said triangular wedges (44) being smaller at a front end for wedging said hook (5); said upper and lower sliding strips (42 and 43) being arrayed longitudinally and said opening (41) being set beyond said upper sliding strip (42) and associating with said two sliding strips (42 and 43); and, (g) a protuberance (45) being installed on a back of a front end of said opening (41).

2. An adjustable combination numerical lock as set forth in claim 1, wherein said hook (5) is wedged in said wedges (44) of said contact chip (4); said contact chip (4) being at a lowest position and being supported by said first, second and third support blocks (26, 27 and 28) and not sliding while engaged with said recesses (81) of said driving rolls (8) when the numerical lock is locked so that said driving rolls (8) rotate with said number dials (6); said sliding strips (42 and 43) being partly engaged with said recesses (81) of said driving rolls (8) and said protuberance (45) of said contact chip (4) being engaged with said middle shute (281) of said support block (28) when the numerical lock is opened; a combination being changeable by turning the hook (5) clockwise and pulling up the hook (5) so that said chip (4) is at a highest position and completely contacts with said first tray (2) by way of said opening (41) enveloping said support block (28) and two of said support blocks (26 and 27) are right outside said chip (4); said sliding strips (42 and 43) completely engaging with said recesses (81) and said protuberance (45) further being engaged with said shute (282) of the front of said support block (28).

* * * * *